US011168557B2

(12) United States Patent
Keilers et al.

(10) Patent No.: US 11,168,557 B2
(45) Date of Patent: Nov. 9, 2021

(54) SYSTEMS AND METHODS FOR INJECTING FLUIDS INTO HIGH PRESSURE INJECTOR LINE

(71) Applicant: Schlumberger Technology Corporation, Sugar Land, TX (US)

(72) Inventors: Adam Ethan Keilers, Richmond, TX (US); Anna Dunaeva, Houston, TX (US); Alhad Phatak, Stafford, TX (US); Herbe Gomez Conzatti y Martinez, Frisco, TX (US); Garud Bindiganavale Sridhar, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/331,170

(22) PCT Filed: Sep. 7, 2017

(86) PCT No.: PCT/US2017/050386

§ 371 (c)(1),
(2) Date: Mar. 7, 2019

(87) PCT Pub. No.: WO2018/048974

PCT Pub. Date: Mar. 15, 2018

(65) Prior Publication Data

US 2019/0218899 A1 Jul. 18, 2019

Related U.S. Application Data

(60) Provisional application No. 62/384,516, filed on Sep. 7, 2016.

(51) Int. Cl.
*E21B 43/267* (2006.01)

(52) U.S. Cl.
CPC ..... *E21B 43/267* (2013.01)

(58) Field of Classification Search
CPC ..... E21B 43/267; E21B 43/26; E21B 21/065; E21B 21/062; E21B 43/34; E21B 34/02; E21B 43/40; E21B 21/066
See application file for complete search history.

(56) References Cited

U.S. PATENT DOCUMENTS 2,478,079 A 8/1949 Beasley et al.
2,755,863 A 7/1956 Stansbury, Jr. et al.
(Continued)

FOREIGN PATENT DOCUMENTS

WO 2007098606 A1 9/2007
WO 2012037676 A1 3/2012
WO 2015088827 A1 6/2015

OTHER PUBLICATIONS

International Search Report issued in International Patent Appl. No. PCT/US2017/050386 dated Dec. 4, 2017; 4 pages.
(Continued)

*Primary Examiner* — Zakiya W Bates

(57) ABSTRACT

A system includes a hydraulic fracturing system including a tank having a slurry and an injector line, where the injector line is disposed between a high-pressure pump and a treatment line to fluidly couple to a wellhead. The system includes a plurality of valves disposed adjacent to the injector line and a control system communicatively coupled to the plurality of valves. The control system fluidly isolates the injector line using the plurality of valves, fills the injector line with an amount of the slurry using a first valve of the plurality of valves, and injects the slurry into the treatment line using a second valve of the plurality of valves.

16 Claims, 7 Drawing Sheets

(56) References Cited

U.S. PATENT DOCUMENTS

| | | | | |
|---|---|---|---|---|
| 3,560,053 | A | 2/1971 | Ortloff et al. | |
| 4,183,813 | A * | 1/1980 | Black | B01D 45/14 210/512.1 |
| 6,269,875 | B1 | 8/2001 | Harrison, III et al. | |
| 6,283,202 | B1 | 9/2001 | Gaines | |
| 7,571,773 | B1 | 8/2009 | West et al. | |
| 7,845,413 | B2 | 12/2010 | Shampine et al. | |
| 7,976,259 | B2 | 7/2011 | Craig et al. | |
| 8,127,844 | B2 | 3/2012 | Luharuka et al. | |
| 8,136,585 | B2 | 3/2012 | Cherewyk | |
| 8,905,133 | B2 | 12/2014 | Potapenko et al. | |
| 9,133,701 | B2 | 9/2015 | Luharuka et al. | |
| 2003/0116314 | A1 | 6/2003 | Dallas | |
| 2003/0221838 | A1 | 12/2003 | Dallas | |
| 2005/0184083 | A1 | 8/2005 | Diaz et al. | |
| 2005/0217868 | A1 | 10/2005 | Dallas et al. | |
| 2006/0289166 | A1 | 12/2006 | Stromquist et al. | |
| 2007/0125544 | A1 | 6/2007 | Robinson et al. | |
| 2007/0197851 | A1 | 8/2007 | Rogers et al. | |
| 2008/0257449 | A1 | 10/2008 | Weinstein et al. | |
| 2009/0095481 | A1 | 4/2009 | Pich et al. | |
| 2010/0147866 | A1 | 6/2010 | Witkowski et al. | |
| 2010/0243255 | A1 | 9/2010 | Luharuka et al. | |
| 2013/0105166 | A1 * | 5/2013 | Medvedev | E21B 21/062 166/308.1 |
| 2014/0000899 | A1 * | 1/2014 | Nevison | E21B 43/26 166/308.1 |
| 2015/0021011 | A1 | 1/2015 | Bihun et al. | |
| 2015/0096739 | A1 | 4/2015 | Ghasripoor et al. | |
| 2015/0184492 | A1 | 7/2015 | Ghasripoor et al. | |
| 2015/0292297 | A1 | 10/2015 | Kajaria et al. | |
| 2015/0292310 | A1 | 10/2015 | Ghasripoor et al. | |
| 2016/0084044 | A1 | 3/2016 | Shen et al. | |
| 2016/0108713 | A1 | 4/2016 | Dunaeva et al. | |
| 2016/0122628 | A1 | 5/2016 | Babcock et al. | |
| 2018/0171770 | A1 | 6/2018 | Roesner et al. | |
| 2018/0363422 | A1 | 12/2018 | Roberts et al. | |

OTHER PUBLICATIONS

Written Opinion issued in International Patent Appl. No. PCT/US2017/050386 dated Dec. 4, 2017; 11 pages.

Office Action issued in Russian Patent Application No. 2019109979 dated Dec. 16, 2020; 19 pages (with English translation).

* cited by examiner

SYSTEMS AND METHODS FOR INJECTING FLUIDS INTO HIGH PRESSURE INJECTOR LINE

CROSS-REFERENCE TO RELATED APPLICATION

This application claims the benefit of U.S. Provisional Application No. 62/384,516, filed 7 Sep. 2016.

BACKGROUND

This disclosure relates generally to systems and methods for delivering an oilfield material to a well at a wellsite.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Production of oil and gas from subterranean formations presents a myriad of challenges. One such challenge is the lack of permeability in certain formations. Often oil or gas bearing formations, that may contain large quantities of oil or gas, do not produce at a desirable production rate due to low permeability. The low permeability may cause a poor flow rate of the sought-after hydrocarbons. To increase the flow rate, a stimulation treatment can be performed. One such stimulation treatment is hydraulic fracturing.

Hydraulic fracturing is a process whereby a subterranean hydrocarbon reservoir is stimulated to increase the permeability of the formation, thereby increasing the flow of hydrocarbons from the reservoir. Hydraulic fracturing includes pumping a fracturing fluid at a high pressure (e.g., in excess of 10,000 psi) to crack the formation and create larger passageways for hydrocarbon flow. The fracturing fluid may have proppants added thereto, such as sand or other solids that fill the cracks in the formation, so that, at the conclusion of the fracturing treatment, when the high pressure is released, the cracks remain propped open, thereby permitting the increased hydrocarbon flow possible through the produced cracks to continue into the wellbore.

To pump the fracturing fluid into the well, large wellsite operations generally employ a variety of positive displacement or other fluid delivering, large scale pumps. However, some fracturing fluids contain particles with diameters that may not easily pass through fracturing equipment (e.g., pumps). In some instances, these larger diameter particles contribute to premature wear and degradation of the large-scale pumps. In other instances, these large diameter particles may not be able to pass through fracturing equipment because clearances in the equipment are smaller than the particles.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a system includes a hydraulic fracturing system including a tank having a slurry and an injector line, where the injector line is disposed between a high-pressure pump and a treatment line to fluidly couple to a wellhead. The system includes a plurality of valves disposed adjacent to the injector line and a control system communicatively coupled to the plurality of valves. The control system fluidly isolates the injector line using the plurality of valves, fills the injector line with an amount of the slurry using a first valve of the plurality of valves, and injects the slurry into the treatment line using a second valve of the plurality of valves.

In another example, a non-transitory computer-readable medium includes computer-executable instructions that cause a processor to transmit a first set of signals to a plurality of valves disposed adjacent to an injector line that provide a slurry into a treatment line fluidly coupled to a wellhead. The first set of signals is configured to fluidly isolate the injector line. The instructions cause the processor to transmit a first signal to a first valve of the plurality of valves, where the first valve is fluidly coupled to a pump that receives the slurry, and where the first signal opens the first valve. The instructions cause the processor to transmit a second signal to the first valve to close when an amount of the slurry within the injector line is above a threshold. The instructions cause the processor to transmit a third signal to a second valve of the plurality of valves, where the second valve fluidly couples the injector line to a high pressure pump, and where the third signal opens the second valve. The instructions cause the processor to transmit a fourth signal to a third valve of the plurality of valves, where the third valve fluidly couples the injector line to the treatment line, and where the fourth signal opens the third valve, thereby displacing the amount of slurry into the treatment line.

In another example, a system includes a low-pressure pump fluidly coupled to a tank including a slurry, an injector line fluidly coupled to the low-pressure pump and a treatment line that fluidly couples to a wellhead, a plurality of valves disposed adjacent to the injector line, and a control system communicatively coupled to the low-pressure pump and the plurality of valves. The control system fluidly isolates the injector line using the plurality of valves, fills the injector line with an amount of the slurry using the low-pressure pump and a first valve of the plurality of valves, and injects the slurry into the treatment line using a second valve and a third valve of the plurality of valves.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
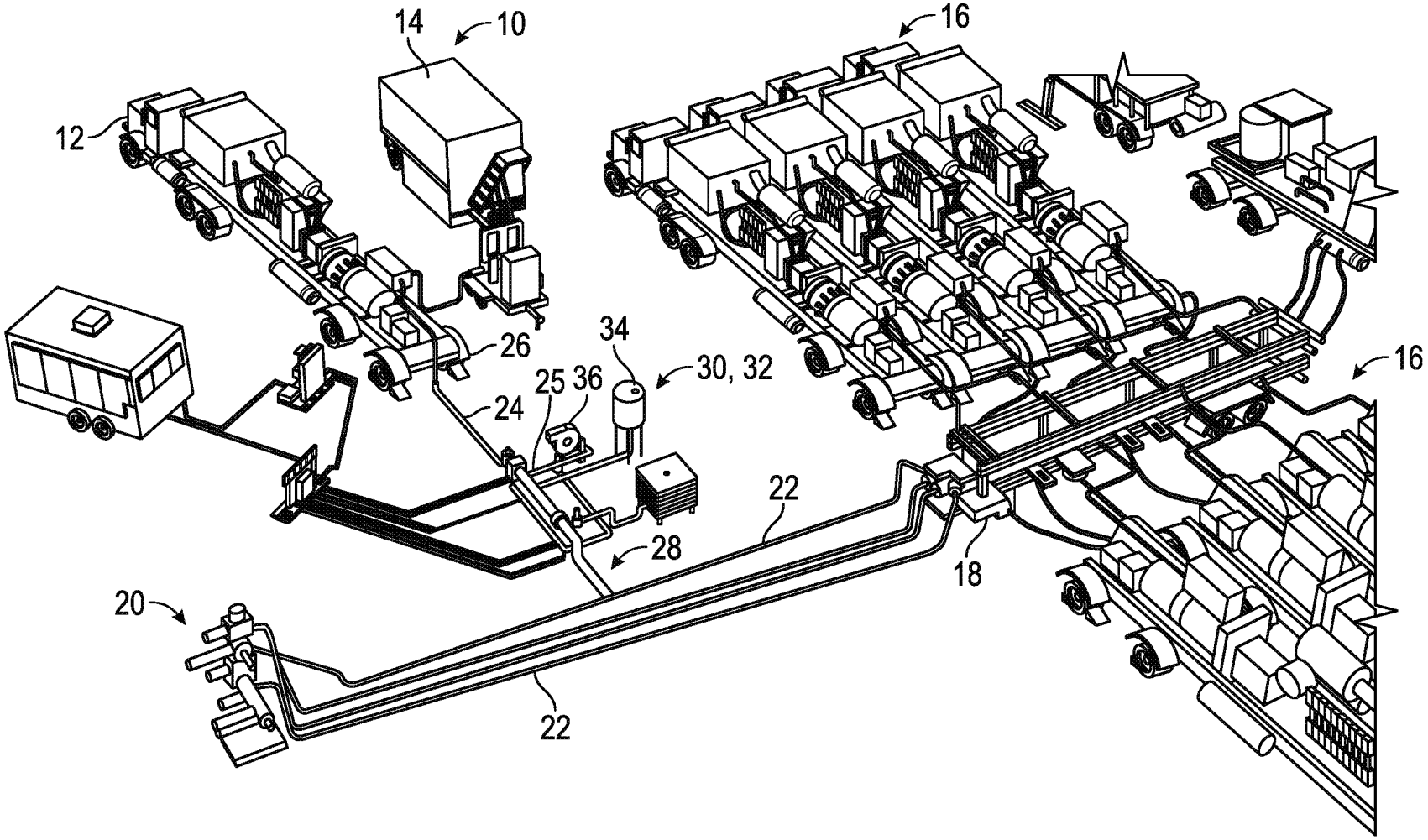
FIG. 1 is a schematic diagram of a wellsite that may be used to introduce oilfield materials into a high pressure fluid flow provided to a wellbore, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The following definitions are provided in order to aid those skilled in the art in understanding the detailed description. The term "treatment", or "treating", refers to any subterranean operation that uses a fluid in conjunction with a desired function and/or for a desired purpose. The term "treatment" or "treating" does not imply any particular action by the fluid. The term "fracturing" refers to the process and methods of breaking down a geological formation and creating a fracture, i.e. the rock formation around a well bore, by pumping fluid at very high pressures (pressure above the determined closure pressure of the formation), in order to increase production rates from a hydrocarbon reservoir. The particular fracturing methods may include any suitable technologies.

The present disclosure relates to systems and methods for introducing an oilfield material, such as a slurry mixture, a diverting fluid, a fracturing fluid, proppant, or proppant additive, to the high-pressure side of a hydraulic well simulation system. The slurry mixture, diverting fluid, fracturing fluid, proppant, or proppant additive may contain larger particles (e.g., with a diameter size of greater than 5 mm), which may be injected into a high-pressure injector line, which may be positioned between a high-pressure pump and a wellhead. The high-pressure injector line is a high-pressure chamber that holds the oilfield material in the line until it is displaced into a treatment line that may be coupled to a wellhead.

The wellsite system enables remote operation of an injector system, thereby enabling multi-stage hydraulic fracturing operations. The injector system includes valves, pumps, and a control system to enable actuation of the injector system throughout the duration of a fracturing treatment. In one embodiment, the larger particle slurries may be provided to a high-pressure injector line via a low-pressure delivery system that may include a tank, a mixer, a vessel, a pump, or a combination thereof. Several valves are disposed along the injector line, the low-pressure delivery system, or the treating line to control the flow of fluids from the low-pressure delivery system to the high-pressure injector line and through the wellsite to the wellbore. A remote actuation system (e.g., a control system) may remotely control the actuation of the control valves through several continuous multistage fracturing treatments. Additional details with regard to how the control system may control the flow of fluids into the wellbore in accordance with the techniques described above will be discussed below with reference to FIGS. 1-9.

By way of introduction, FIG. 1 is a high-level schematic diagram of a wellsite system 10 that may be used to provide oilfield materials into a high-pressure fluid flow used in the stimulation of subsurface formations through a wellbore, in accordance with an embodiment. The wellsite system 10 may include various pieces of equipment to complete the stimulation of the subsurface formation, such as hydraulic fracturing equipment. The above-ground hydraulic fracturing equipment may include a fracturing pump 12, a hydration unit 14, a battery of pump unit trailers 16, a manifold (e.g., missile) trailer 18 coupled to the battery of pump unit trailers 16, a wellhead 20, and one or more control systems (not shown). The above-ground hydraulic fracturing equipment may also include one or more treating lines 22. The treating lines 22 may be used to provide a pressurized slurry mixture into the wellhead 20 for use in the hydraulic fracturing operation. The treating lines 22 may be fluidly coupled to an injector line 24.

The injector line 24 has a first end 26 coupled to the fracturing pump 12 and a second end 28 coupled to the one of the treating lines 22. In one embodiment, the injector line 24 receives a slurry mixture 30 from a blender system 32. The blender system 32 may be used to introduce the slurry mixture 30 to the high-pressure injector line 24. The low-pressure blender system 32 enables the large particles (e.g., particles with a diameter of greater than 5 mm) contained in the slurry mixture 30 to be displaced into the high-pressure injector line 24. The amount of slurry mixture 30 that may be displaced into the high-pressure injector line 24 may range from approximately 1 gallon to over 20 gallons of fluid. The amount of slurry mixture 30 used in each of the continuous multi-stages fracturing stages may vary. The blender system 32 may include at least a slurry tank 34 and a low-pressure pump 36. The low-pressure blender system 32 may use a pump to introduce the slurry mixture 30 from the tank 34 into the injector line 24, displace the slurry mixture 30 from the tank 34 into the injector line 22 using air pressure, or feed the slurry mixture 30 from the tank 34 into the injector line 24 via a gravity feed.

The blender system 32 may prepare the slurry for delivery to the injector line 24 via a slurry line 25 (e.g., a conduit). As described above, the blender system 32 may be used to store and provide oilfield materials, such as the slurry mixture 30, a fracturing fluid, proppant (e.g., high value proppant), and proppant additive, which have a larger particle size (e.g., greater than 5 mm diameter particles) into the treating line 22 without being pumped via the fracturing pump 12. The blender system 32 may be electronically or manually controlled, as explained further with reference to FIGS. 2-5. It may be appreciated that the injector line 24 includes several valves, pumps, and a control system to enable actuation of the valves along the injector line throughout the duration of a fracturing treatment. The fracturing pump 12 may be a reciprocating plunger pump, a centrifugal pump, or any other kind of pump capable of producing high enough pressure for delivering the slurry into the wellhead.

Figure 2:
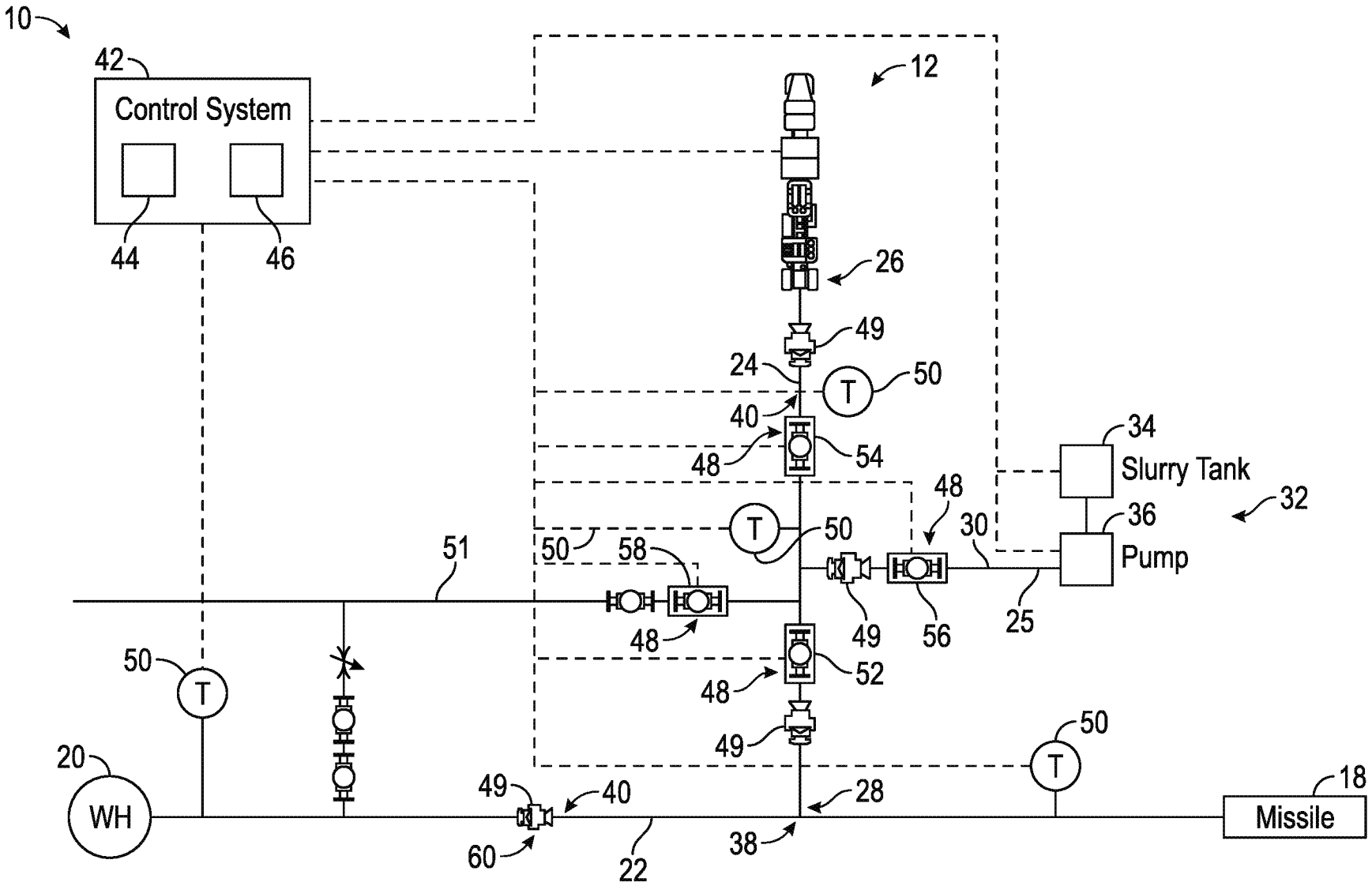
FIG. 2 is a schematic diagram representing fluid flow through an injector line and a treating line toward a wellhead of the wellbore, in accordance with an embodiment.

FIG. 2 is a schematic diagram representing fluid flow through the injector line 24 and the treating line 22 toward the wellhead 20, in accordance with an embodiment. In the illustrated embodiment, the injector line 24 fluidly couples to the treating line 22 between the missile tray 18 and the wellhead 20. The position at which the injector line 24 intersects the treating line 22 may vary. For example, an intersection point 38 may be closer to the missile tray 18 or closer to the wellhead 20. A process vent line 51 intersects the injector line 24 downstream from the blender system 32. The process vent line 51 may be used to release pressure from the injector line 24.

As described above, the injector line 24 is fluidly coupled the fracturing pump 12. The fracturing pump 12 may be used to move a displacement fluid 40 in the injector line 24 into the treating line 22. The displacement fluid 40 may move the oilfield materials (e.g., slurry mixture 30, diverting fluid, fracturing fluid, proppant, and proppant additive) through the injector line 24 to the treating line 22. By way of example, the injector line 24 may withstand pressures as high as 15,000 psi. The high pressure flow of the fluid 40 that flows through the injector line 24 and the treating line 22 may be monitored via a control system 42.

The control system 42 may include data acquisition circuitry 44 and data processing circuitry 46. The data processing circuitry 46 may be a microcontroller or microprocessor, such as a central processing unit (CPU), which may execute various routines and processing functions. For example, the data processing circuitry 44 may execute various operating system instructions as well as software routines configured to effect certain processes. These instructions and/or routines may be stored in or provided by an article of manufacture, which may include a computer-readable medium, such as a memory device (e.g., a random access memory (RAM) of a personal computer) or one or more mass storage devices (e.g., an internal or external hard drive, a solid-state storage device, CD-ROM, DVD, or other storage device).

Such data associated with the present techniques may be stored in, or provided by, a memory or mass storage device of the control system 42. Alternatively, such data may be provided to the data processing circuitry 46 of the control system 42 via one or more input devices. In one embodiment, data acquisition circuitry 44 may represent one such input device; however, the input devices may also include manual input devices, such as a keyboard, a mouse, or the like. In addition, the input devices may include a network device, such as a wired or wireless Ethernet card, a wireless network adapter, or any of various ports or devices configured to facilitate communication with other devices via any suitable communications network, such as a local area network or the Internet. Through such a network device, the control system 42 may exchange data and communicate with other networked electronic systems. The network may include various components that facilitate communication, including switches, routers, servers or other computers, network adapters, communications cables, and so forth.

The control system 42 may be used to control the fracturing pump 12, the low-pressure pump 36, or other equipment in the wellsite 10. In one embodiment, the control system 42 may control the control valves 48 disposed throughout the wellsite 10. For example, a first injector line valve 52 may be disposed along the injector line 24 between the treating line 22 and the process vent line 51. A second injector valve 54 may be disposed upstream from the first injector line valve 52 along the injector line 24. The second injector valve 54 may be disposed between the vent line 51 and the high-pressure fracturing pump 12. In certain embodiments, the control system 42 may control the actuation of one or more valves 48 (e.g., the first injector line valve 52, the second injector valve 54) according to processes described herein. It may be appreciated that the control system 42 sends a signal to a controller associated with the device (e.g., the control valve 48) that is being controlled (e.g., actuated). In one embodiment, the first injector valve 52 may be disposed between the treating line 22 and the process vent line 51, and the second injector valve 54 may be disposed along the injector line 24 between the vent line 51 and the high-pressure fracturing pump 12. In another embodiment, the first injector valve 52 may be disposed between the treating line 22 and the process vent line 51, and the second injector valve 54 may be disposed along the injector line between the slurry line 25 and the missile tray 18. The injector valves 52, 54 may be used to isolate a portion of the injector line 24 between the injector valves 52, 54 to create a high pressure chamber to receive the oilfield materials (e.g., the slurry mixture 30, diverting fluid, fracturing fluid, proppant, and proppant additive, which have a larger particle size (e.g., greater than 5 mm diameter particles) until they are displaced into the treating line 22 The control system 42 may also control the actuation of control valves 48 disposed on the slurry line 25 (e.g., an inlet valve 56), the vent line 51 (e.g., a bleed valve 58), and/or the treating line 22 (e.g., a check valve 60). It may be appreciated that the injector line 24 and/or the treating line 22 may include one or more check valves 49 (e.g., the check valve 60) to reduce or prevent the occurrence of backflow of the fluid 40 through the lines. It should further be appreciated that the remote actuation system may include some manual operation valves that are not controlled by the control system 42. Still further, the wellsite 10 equipment may be arranged in alternative arrangements and/or with greater or fewer redundancies. For example, the injector line 24 may use one valve 48 to control the flow of the fluids 40 through the injector line 24, as opposed to more than one valve 48.

To control the actuation of the valves 48, the control system 42 may receive signals from one or more sensors 50 disposed throughout the wellsite system 10. For example, the wellsite system 10 may include sensors 50 that measure a line pressure (e.g., treating line pressure, injector line pressure), flow sensors (e.g., to measure flow rate of the slurry mixture 30), displacement sensors (e.g., to sense a valve position), level sensors (e.g., to measure a tank level), concentration sensors (e.g., to measure a proppant concentration of the slurry mixture), or other suitable sensors. It may be appreciated that one or more of the sensors 50 may function as transducer (e.g., to receive a signal and retransmit in a different form). In the illustrated embodiment, the injector line 24 may include at least one pressure sensor 50 disposed adjacent to the first injector line valve 52 and a second pressure sensor 50 disposed adjacent the second injector valve 54. Other sensors 50 may output data indicative of operating conditions throughout the wellsite 10. For example, the treating line 22 may have sensors 50 to monitor the pressure of the treating line 22. Each of the actuated valves 48 may include a displacement sensor 50 to output data indicative of the position of the valve 48. A method of controlling the actuation of the valves in order to control the injection of the oilfield materials, such as the slurry mixture 30, diverting fluid, fracturing fluid, proppant, and proppant additive, into the treating line 22 will be described with respect to FIG. 3.

Figure 3:
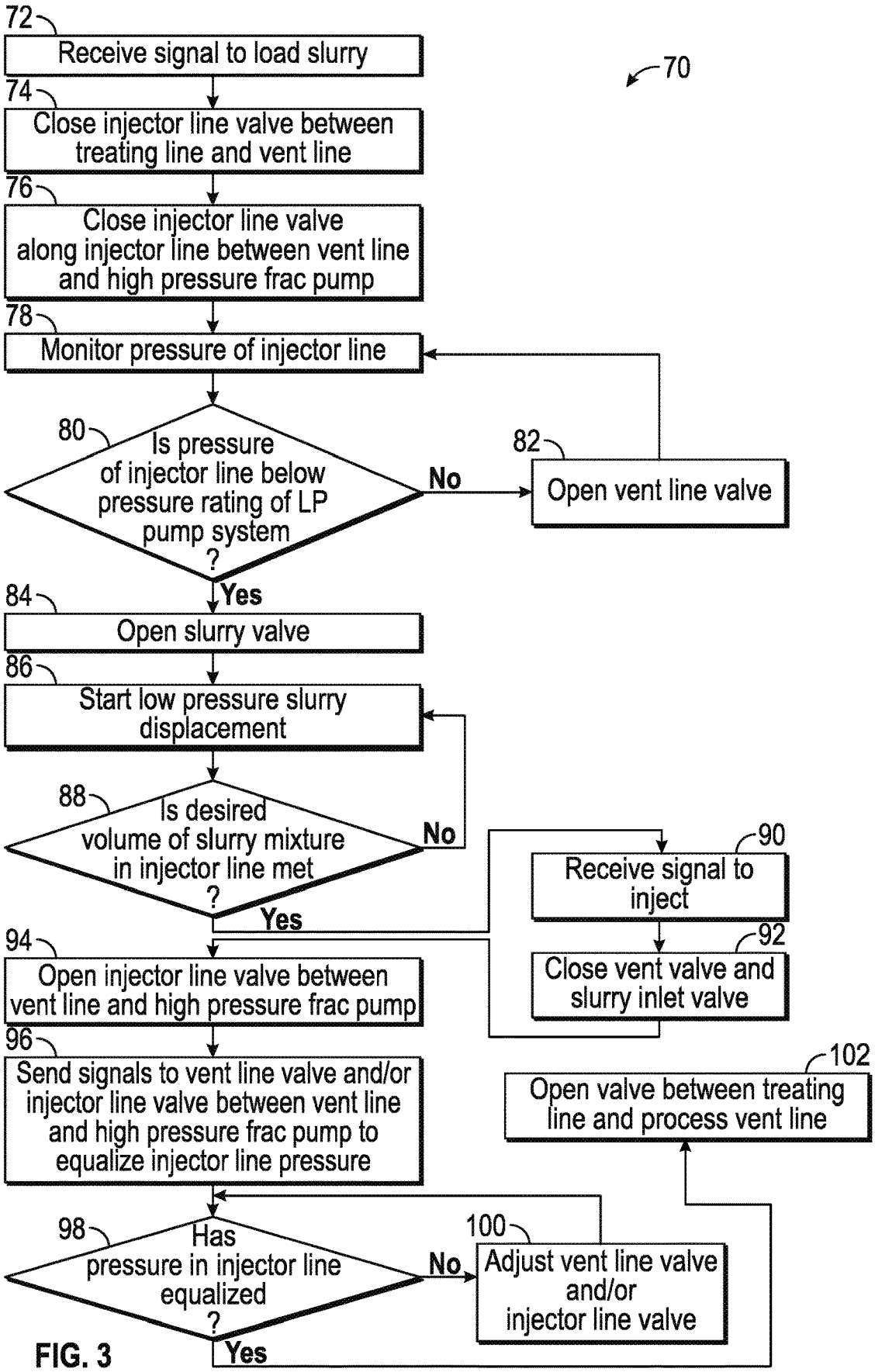
FIG. 3 illustrates a flowchart of a method for performing an injection of a slurry through the injector line and treating lines toward the wellhead of the wellbore, in accordance with an embodiment.

FIG. 3 illustrates a flowchart of a method 70 for performing a large particle injection through the injector line 24 and treating lines 22 via the control system 42, in accordance with an embodiment. Although the following description of the method 70 is described as being performed by the control system 42, it should be noted that any suitable processor device may perform the method 70 described herein. Moreover, it should be understood that the method 70 described below is not limited to be performed in the order presented herein; instead the method 70 may be performed in any suitable order.

Referring now to FIG. 3, the control system 42 may initially receive (block 72) a signal to load the slurry mixture 30. After receiving the signal, the control system 42 may close (block 74) the injector line valve 52 between the treating line 22 and the process vent line 51. Next, the control system 42 may close (block 76) the injector line valve 54 disposed along the injector line 24 between the vent line 51 and the high-pressure fracturing pump 12. After both of the injector line valves 52, 54 are closed, the injector line 24 may be isolated from the high-pressure fracturing pump 12 and the treating line 22. The control system 42 may then monitor (block 78) the pressure of the injector line 24 via a respective sensor 50. The control system 42 may then determine (block 80) whether the pressure of the injector line 24 is below a pressure rating of the low-pressure pump system (e.g., the pressure rating of the pump 36). The control system 42 may then open (block 82) the vent line valve 58 to release some of the stored pressure within the injector line 24. If the pressure rating remains above the pressure rating of the low pressure pump system adjacent to the injector line 24, the control system 42 may continue to monitor (block 78) the pressure of the injector line 24. When the pressure of the injector line 24 falls below the pressure rating of the low pressure pump system, the control system 42 may open (block 84) the slurry valve 56 to fill the injector line 24.

The control system 42 then begins to displace (block 86) the low pressure slurry mixture 30. The control system 42 then determines (block 88) whether the injector line 24 is filled with the desired volume of slurry mixture based on data received via a respective sensor 50. If the volume remains of the slurry mixture is below the desired volume, the control system 42 performs no action and allows the displacement (block 86) of the low pressure slurry mixture 30 to continue so that the slurry mixture continues fill the injector line 24. When the control system 42 determines the desired volume of slurry mixture has been filled into the injector line 24 based on data received via the respective sensor 50, the control system 42 may then receive (block 90) a signal to inject the slurry mixture 30 into the treatment line 22. The control system 42 then closes (block 92) the vent line valve 58 and the slurry valve 56. The control system 42 then opens (block 94) the injector line valve 54 between the vent line 51 and the high pressure fracturing pump 12. The control system 42 then equalizes the pressure (block 96) of the injector line 24 by sending signals to the vent line valve 58 and/or to the injector line valve 54 between the vent line 51 and the high pressure fracturing pump 12 to adjust the pressure of the injector line 24. The control system 42 then determines (block 98) whether the pressure in the injector line 24 has equalized.

If the pressure in the injector line 24 has not equalized, the control system 42 adjusts (block 100) the vent line valve 58 and/or the injector line valve 54 between the vent line 51 and the high pressure fracturing pump 12. After the pressure in the injector line 24 has been equalized, the control system 42 may open (block 102) the valve 52 between the treating line 22 and the process vent line 51, thereby providing the slurry mixture 30 inline with the fluids 40 provided to the wellhead 20 via the treating line 22.

Figure 4:
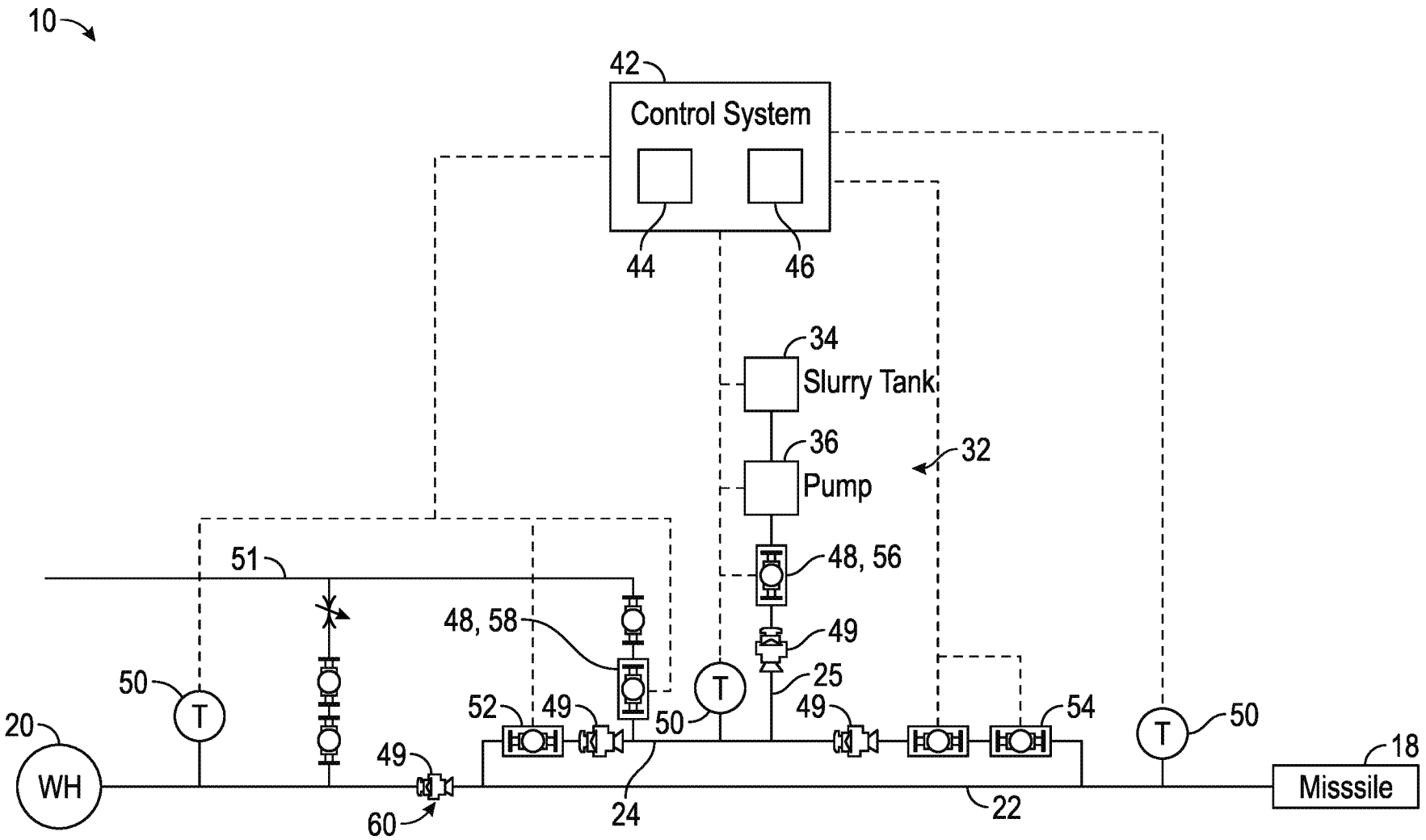
FIG. 4 is a schematic diagram representing fluid through an injector line and a treating line toward the wellhead of the wellbore, in accordance with an embodiment.

With the foregoing in mind, FIG. 4 is a schematic diagram representing a second embodiment in which fluid may flow through the injector line 24 and the treating line 22 toward the wellhead 20. In the illustrated embodiment, the injector line 24 may be positioned substantially parallel to the treating line 22. Both the treating line 22 and the injector line 24 are disposed between the missile tray 18 and the wellhead 20. The process vent line 51 may intersect the injector line 24 and may be used to release pressure from the injector line 24.

As described above with reference to FIGS. 2-3, the control system 42 may control the control valves 48 disposed throughout the wellsite 10. For example, the first injector line valve 52 may be disposed along the injector line 24 between the treating line 22 and the process vent line 51. The second injector valve 54 may be disposed downstream from the first injector line valve 52. The second injector valve 54 may be disposed between the slurry line 25 and the missile tray 18. The injector valves 52, 54 may be used to isolate a portion of the injector line 24 between the injector valves 52, 54 to create a high pressure chamber to receive the oilfield materials (e.g., the slurry mixture 30, a fracturing fluid, proppant, and proppant additive, which have a larger particle size (e.g., greater than 5 mm diameter particles) until they are displaced into the treating line 22 The control system 42 may control the actuation of one or more valves 48 (e.g., the first injector line valve 52, the second injector valve 54). The control system 42 may also control the actuation of control valves 48 disposed on the slurry line 25 (e.g., an inlet valve 56), the vent line 51 (e.g., a bleed valve 58), and/or the treating line 22 (e.g., a check valve 60). A method 104 of controlling the actuation of the valves 48 to control the injection of the oilfield materials, such as the slurry mixture 30, a fracturing fluid, proppant, and proppant additive, into the treating line 22 will be discussed below with respect to FIG. 5.

Figure 5:
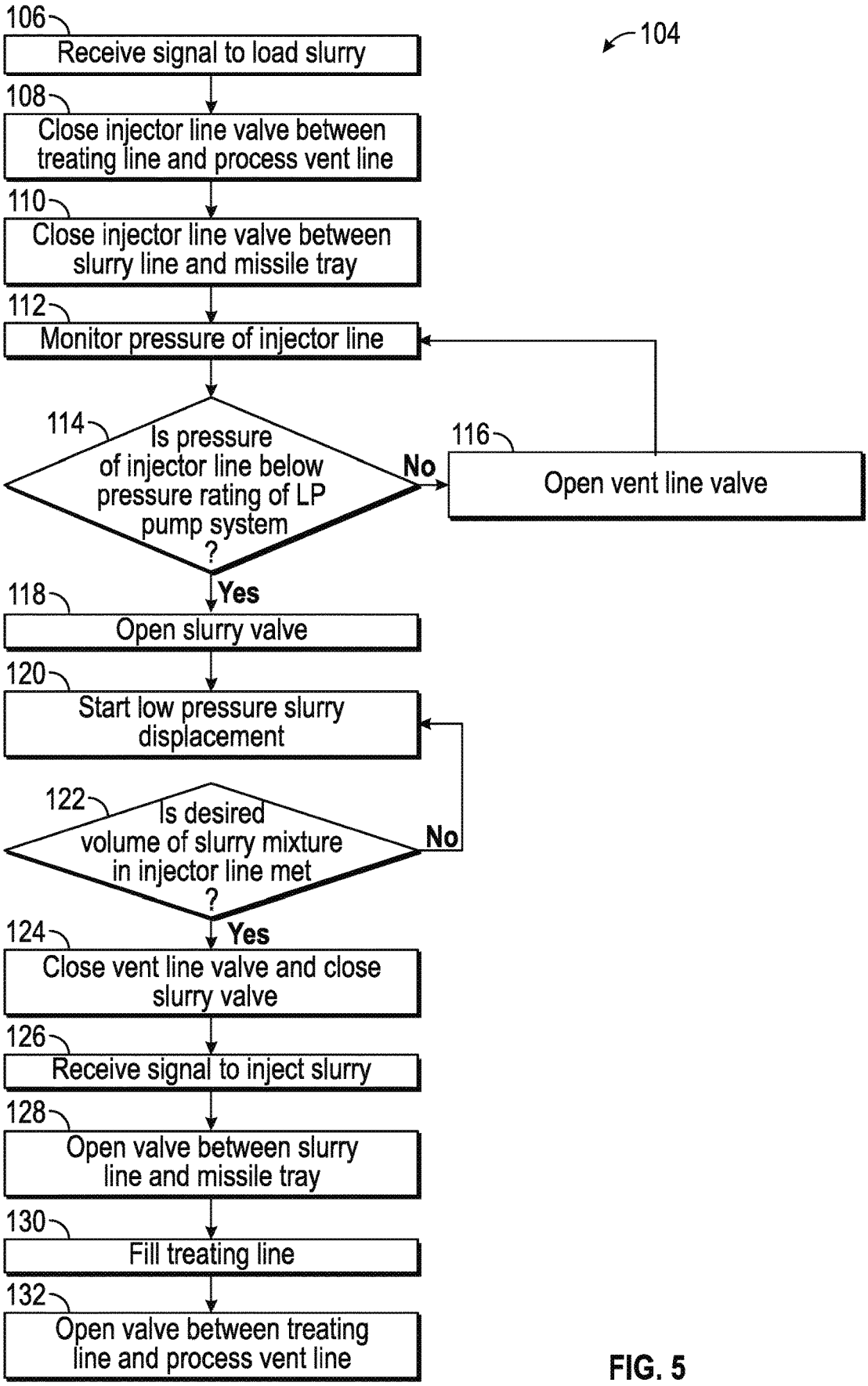
FIG. 5 illustrates a flowchart of a method for performing an injection of a slurry through the injector line and treating lines toward the wellhead of the wellbore, in accordance with an embodiment.

FIG. 5 illustrates a flowchart of a method 104 for performing a large particle injection through the injector line 24 and treating lines 22 via the control system 42, in accordance with an embodiment. Although the following description of the method 104 is described as being performed by the control system 42, it should be noted that any suitable processor device may perform the method 104 described herein. Moreover, it should be understood that the method 104 described below is not limited to be performed in the order presented herein; instead the method 104 may be performed in any suitable order.

Referring now to FIG. 5, the control system 42 may initially receive (block 106) a signal to load the slurry mixture 30. Then, the control system 42 closes (block 108) the injector line valve 52 between the treating line 22 and the process vent line 51. Next, the control system 42 closes (block 110) the injector line valve 54 disposed along the injector line between the slurry line 25 and the missile tray 18. The control system 42 then monitors (block 112) the pressure of the injector line 24 by measuring the pressure via a respective pressure sensor 50. The control system 42 then determines (block 114) if the pressure of the injector line 24 is below the pressure rating of the low pressure pump system (e.g., the pressure rating of the pump 36). If the pressure rating remains above the pressure rating of the low pressure pump system, the control system 42, the control system 42 opens (block 116) the vent line valve 58 and continues to monitor (block 112) the pressure of the injector line 24.

When the pressure of the injector line 24 falls below the pressure rating of the low pressure pump system, the control system 42 opens (block 118) the slurry valve 56 to fill the injector line 24. The control system 42 then begins to displace (block 120) the low pressure slurry mixture 30. The control system 42 then determines (block 122) if the injector line 24 is filled with the desired volume of slurry mixture 30 based on data received via a respective sensor 50 that details an amount of the slurry mixture 30 is present in the injector line 24. If the volume remains of the slurry mixture 30 is below the desired volume, the control system 42 performs no action and allows the displacement (block 120) of the low pressure slurry mixture 30 to continue so that the slurry mixture continues fill the injector line 24. When the control system 42 determines the desired volume of slurry mixture has been filled into the injector line 24, the control system 42 closes (block 124) the vent line valve 58 and the slurry valve 56.

When the control system 42 determines the desired volume of slurry mixture has been filled into the injector line 24 based on data received via the respective sensor 50, the control system 42 may then receive (block 126) a signal to inject the slurry mixture 30 into the treatment line 22. The control system 42 then opens (block 128) the valve 54 between the slurry line 25 and the missile tray 18. Then the control system 42 opens the valve 54 to fill (block 130) to enable flow of the slurry mixture 30 from the injector line 24 to the treating line 22. The control system 42 then opens (block 132) the valve 52 between the treating line 22 and the process vent line 51. As a result, the slurry mixture 30 enters the treating line 22, and the flow of the treating line 22 displaces the slurry mixture into the wellhead 20. In some embodiments, the control system 42 may open the valve 52 before the valve 54 prior to the treating line 22 being completely filled to allow the slurry mixture 30 to enter the treating line 22 closer the wellhead before the valve 54 is opened. Alternatively, the control system 42 may open the valve 52 and the valve 54 simultaneously to fill the treating line 22. The methods of injecting the slurry mixture 30 enable the injection of oilfield materials with larger diameter particles to be displaced from a low-pressure side to a high-pressure side of the injector line 22 for use in a wellbore without pushing the slurry mixture 30 through a high-pressure pump.

FIGS. 6-9 illustrate various embodiments of the low-pressure blender system 32 that may be used to introduce the slurry mixture 30 to the high-pressure injector line 24. As described above, the low-pressure blender system 32 enables the large particles (e.g., particles with a diameter of greater than 5 mm) contained in the slurry mixture 30 to be displaced into the high-pressure injector line 24. The amount of slurry mixture 30 that may be displaced into the high-pressure injector line 24 may range from approximately 1 gallon to over 20 gallons of fluid. It may be appreciated that the slurry mixture 30 may have a range of solids concentration. In some scenarios, the slurry mixture 30 may have a lower concentration of solids and may be relatively dilute with a higher liquid concentration. In other scenarios, the slurry mixture 30 may be have a relatively higher concentration of solids and may have a lower liquid content. The low-pressure blender system 32 may use a pump to introduce the slurry mixture 30 from the tank 34 into the injector line 24, displace the slurry mixture 30 from the tank 34 into the injector line 24 using air pressure, or feed the slurry mixture 30 from the tank 34 into the injector line 24 via a gravity feed. The blender system 32 may be selected based in part on the concentration of the slurry mixture 30. For example, the blender system 32 may use a gravity fed slurry line 25 (see FIG. 8) when the concentration of the slurry mixture 30 has a concentration of solid particles. As will be appreciated, the slurry tank 34 may include a mixer 130 to enable mixing of the fracturing fluid, proppant, and proppant additive to form the slurry mixture 30.

Figure 6:
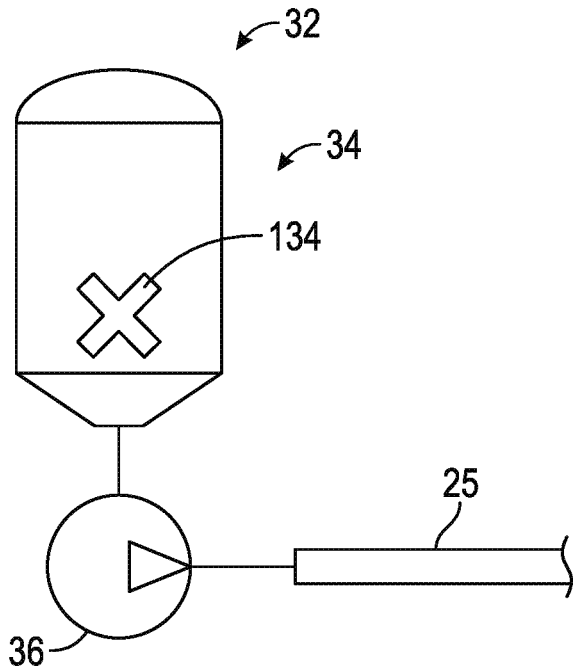
FIG. 6 illustrates a schematic diagram representing one embodiment of a blender system to introduce a slurry mixture toward the injector line of FIGS. 2 and 4, in accordance with an embodiment.

FIG. 6 illustrates a schematic diagram representing one embodiment of the blender system 32 that may provide the slurry mixture 30 for the injector line 24. In the illustrated embodiment, the mixer 134 is utilized to mix the slurry mixture 30. The blender system 32 then uses the low-pressure pump 36 to introduce the slurry mixture 30 to the injector line 24 via the slurry line 25. The low-pressure pump 36 may operate at a low flow rate to allow the solids having relatively large diameter particles to move through the pump 36 without inhibiting the operation of the pump 36. By way of example, the low-pressure pump 36 may operate at a pressure of less than 150 psi.

Figure 7:
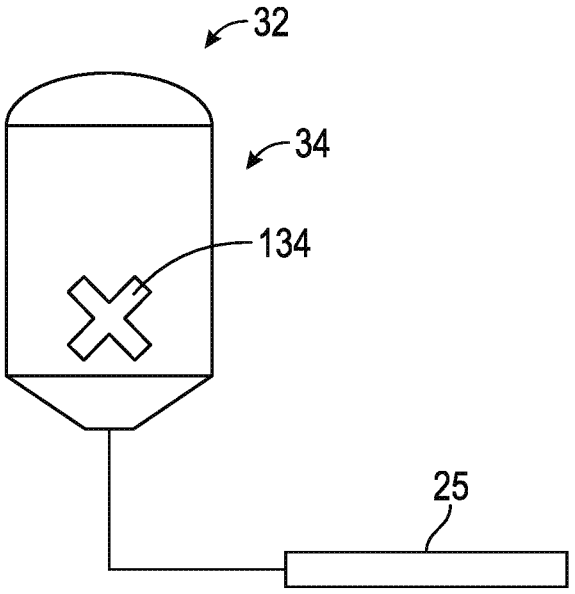
FIG. 7 illustrates a schematic diagram representing another embodiment of a blender system to introduce the slurry mixture toward the injector line of FIGS. 2 and 4, in accordance with an embodiment.

FIG. 7 illustrates a schematic diagram representing a second embodiment of the blender system 32 to provide the slurry mixture 30 toward the injector line 24 of FIGS. 2 and 4, in accordance with an embodiment. In the illustrated embodiment, the blender system 32 uses the mixer 134 to mix the slurry mixture 30 within the tank 34. In the present embodiment, the blender system 32 may use air pressure (e.g., pneumatic pressure) to displace the slurry mixture 30 into the slurry line 25 from the tank 34. The air pressure may be provided via an air volume control system (e.g., a compressor, a pressure sensor, a level sensor). When the air dissolves into the tank contents, the tank level may rise and the air pressure may fall, triggering the compressor to pump air into the tank 34 to displace the slurry mixture 30.

Figure 8:
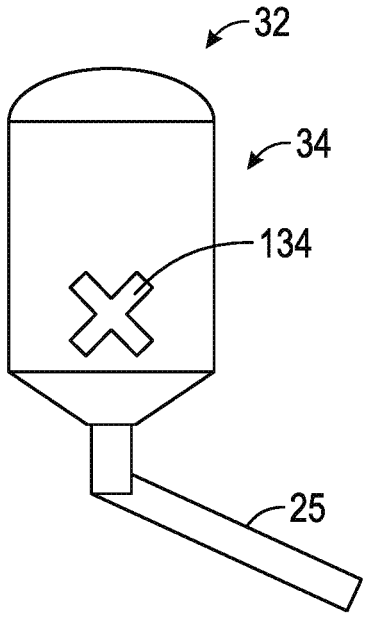
FIG. 8 illustrates a schematic diagram representing a third embodiment of a blender system to introduce the slurry mixture toward the injector line of FIGS. 2 and 4, in accordance with an embodiment.

FIG. 8 illustrates a schematic diagram representing a third embodiment of the blender system 32 to provide the slurry mixture 30 toward the injector line 24 of FIGS. 2 and 4. In the illustrated embodiment, the blender system 32 uses the mixer 134 to mix the slurry mixture 30 within the tank 34. The blender system 32 may include the slurry line 25 positioned at an angle with respect to the ground, such that the slurry mixture 30 uses a gravity to displace the slurry mixture 30 into the slurry line 25. That is, by angling the slurry line 25, the contents of the slurry line 25 may be pulled down from the tank 34 via gravitational forces.

Figure 9:
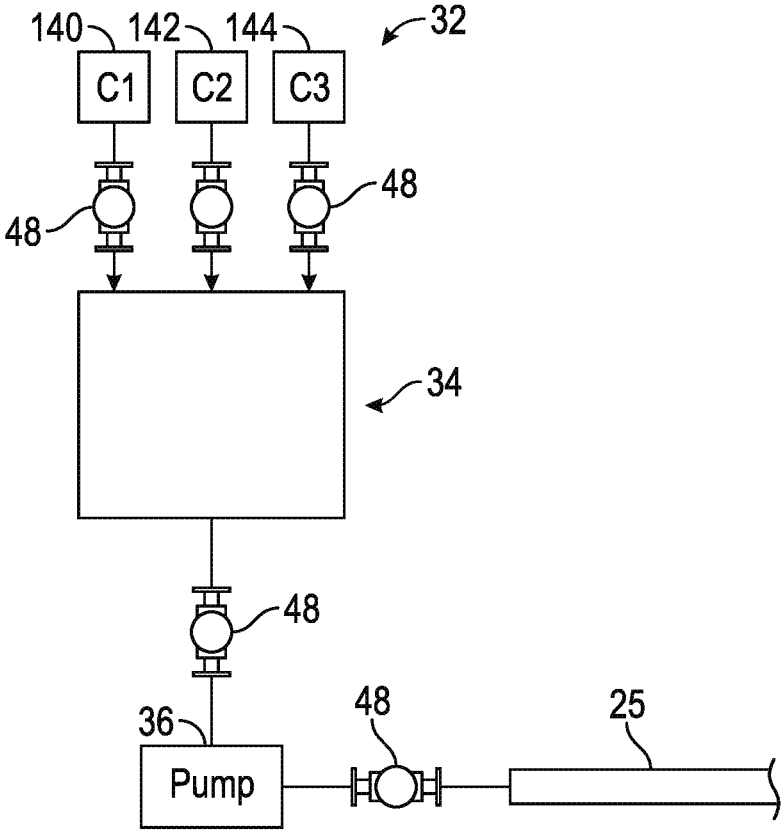
FIG. 9 illustrates a schematic diagram representing a fourth embodiment of a blender system to introduce the slurry mixture toward the injector line of FIGS. 2 and 4, in accordance with an embodiment.

FIG. 9 illustrates a schematic diagram representing a fourth embodiment of the blender system 32 to provide the slurry mixture 30 toward the injector line 24 of FIGS. 2 and 4, in accordance with an embodiment. In the illustrated embodiment, the blender system 32 may facilitate on-the-fly mixing of several components. For example, the blender system 32 may include several components (e.g., component 140, component 142, component 144) that may store various types of materials that may be mixed together to prepare the slurry mixture 30. The content of the components 140, 142, 144 may be added together to create a desired composition of the slurry mixture 30 that can be adjusted on-site during and between pumping stages to meet site-specific job demands. That is, the blender system 32 may use one or more valves 48 to control the flow of content from each respective component 140, 142, 144 to create the slurry mixture 30 having the desired composition. In addition, the valves 48 may be in positions downstream of the tank 34 and between the pump 36 and the slurry line 25.

The control system 42 may control the actuation of each of the valves 48 in accordance with a desired flow rate, time, concentration, or any combination thereof. For instance, the control system 42 may receive a desired composition of the slurry mixture 30 that may include 25% content A from component 140, 25% content B from component 142, and 50% content C from component 144. As such, the control system 42 may control the operation of each respective valve 48 between the components 140, 142, and 144, such that the content of the tank 34 is composed of 25% content A, 25% content B, and 50% content C. A mixer 134 may then mix the contents together to form the slurry mixture 30. The control system 42 may then control the operation of the valves 48 downstream from the tank 34 to provide the slurry mixture 30 to the slurry line 25.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A hydraulic fracturing system comprising:

a tank comprising a slurry;

an injector line, wherein the injector line is disposed between a high-pressure pump and a treatment line configured to fluidly couple to a wellhead;

a plurality of valves disposed adjacent to the injector line; and a control system communicatively coupled to the plurality of valves, wherein the control system is configured to:

fluidly isolate the injector line using the plurality of valves;

fill the injector line with an amount of the slurry after the injector line is fluidly isolated using a first valve of the plurality of valves; and inject the slurry into the treatment line after the injector line is filled with the amount of the slurry using a second valve of the plurality of valves.

2. The hydraulic fracturing system of claim 1, wherein the slurry comprises a diverting material.

3. The hydraulic fracturing system of claim 2, wherein the slurry comprises particles that have a diameter greater than or equal to 5 mm.

4. The hydraulic fracturing system of claim 1, wherein a low-pressure pump is fluidly coupled to the injector line via a conduit.

5. The hydraulic fracturing system of claim 1, comprising a pressure sensor configured to measure a pressure associated with the injector line.

6. The hydraulic fracturing system of claim 5, wherein the control system is configured to open a third valve of the plurality of valves to vent the injector line.

7. The hydraulic fracturing system of claim 6, wherein the control system is configured to open the third valve when the pressure is above a threshold.

8. The hydraulic fracturing system of claim 1, comprising a missile tray configured to provide pressure to the treatment line.

9. A system comprising:

a low-pressure pump fluidly coupled to a tank comprising a slurry;

an injector line fluidly coupled to the low-pressure pump and a treatment line configured to fluidly couple to a wellhead;

a plurality of valves disposed adjacent to the injector line; and a control system communicatively coupled to the low-pressure pump and the plurality of valves, wherein the control system is configured to:

fluidly isolate the injector line using the plurality of valves;

fill the injector line with an amount of the slurry after the injector line is fluidly isolated using the low-pressure pump and a first valve of the plurality of valves; and inject the slurry into the treatment line after the injector line is filled with the amount of the slurry using a second valve and a third valve of the plurality of valves.

10. The system of claim 9, comprising a pressure sensor configured to measure a pressure associated with the injector line.

11. The system of claim 9, comprising a check valve configured to reduce backflow of the slurry through the injector line.

12. The system of claim 9, wherein the treatment line is fluidly coupled to a missile tray configured to provide pressure to the treatment line.

13. The system of claim 9, comprising a plurality of components and a second plurality of valves, wherein each of the plurality of components comprise a respective material that make up the slurry.

14. The system of claim 13, wherein the control system is configured adjust an amount of the respective material provided via the plurality of components into the tank using the second plurality of valves.

15. The system of claim 9, wherein the control system is configured to open a fourth valve of the plurality of valves to vent the injector line.

16. The system of claim 15, wherein the control system is configured to open the fourth valve when a pressure associated with the injector line is above a threshold.

* * * * *